US006479453B2

(12) United States Patent
Man

(10) Patent No.: US 6,479,453 B2
(45) **Date of Patent: *Nov. 12, 2002**

(54) ALKALINE CLEANERS BASED ON ALCOHOL ETHOXY CARBOXYLATES

(75) Inventor: Victor Fuk-Pong Man, Minneapolis, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/872,675

(22) Filed: Jun. 1, 2001

(65) Prior Publication Data

US 2001/0044396 A1 Nov. 22, 2001

Related U.S. Application Data

(63) Continuation of application No. 08/469,809, filed on Jun. 6, 1995, now Pat. No. 6,274,541, which is a continuation of application No. 08/200,631, filed on Feb. 23, 1994, now abandoned.

(51) Int. Cl.[7] ..... C11D 1/06; C11D 3/33; B08B 7/00

(52) U.S. Cl. ..... 510/365; 510/109; 510/238; 510/435; 510/480; 510/506; 134/40

(58) Field of Search ..... 510/365, 109, 510/238, 435, 480, 506; 134/40

(56) References Cited

U.S. PATENT DOCUMENTS

| | | | | |
|---|---|---|---|---|
| 3,298,956 A | | 1/1967 | Irani et al. | |
| 3,528,923 A | | 9/1970 | Atherton et al. | |
| 3,660,470 A | | 5/1972 | Hirst | |
| 3,767,584 A | | 10/1973 | Hirst | |
| 3,850,834 A | | 11/1974 | Hellsten et al. | |
| 3,941,710 A | | 3/1976 | Gilbert et al. | |
| 4,000,081 A | | 12/1976 | Woo | |
| 4,399,050 A | | 8/1983 | Bentham et al. | |
| 4,797,223 A | | 1/1989 | Amick et al. | |
| 4,861,518 A | | 8/1989 | Morganson et al. | |
| 4,891,149 A | | 1/1990 | Nagarjan et al. | |
| 5,298,195 A | | 3/1994 | Brumbaugh | |
| 5,376,310 A | | 12/1994 | Cripe et al. | |
| 5,378,409 A | | 1/1995 | Ofosu-Asante | |
| 5,415,813 A | * | 5/1995 | Misselyn et al. | 510/365 |
| 5,736,503 A | * | 4/1998 | Vinson | 510/481 |

FOREIGN PATENT DOCUMENTS

| | | |
|---|---|---|
| CA | 1 232 817 | 2/1988 |
| DE | 3 639 885 | 6/1988 |
| EP | 0 121 286 | 10/1984 |
| GB | 2 076 010 | 11/1985 |
| NL | 7 107 579 | 12/1972 |
| WO | WO 92/0877 | 5/1992 |

OTHER PUBLICATIONS

Derwent Publications Ltd., London, GB; AN 93–299874 & JP, A/05 214 362 (Lion Corp.) (Aug. 24, 1993).

Foley, J., "Hard Surface Cleaners Present New Opportunities for Formulators", *Soap–Cosmetics–Chemical Specialties*, vol. 63, p. 38(3) (Sep. 1987).

* cited by examiner

*Primary Examiner*—Lorna M. Douyon
(74) *Attorney, Agent, or Firm*—Merchant & Gould P.C.

(57) ABSTRACT

An alkaline cleaner composition comprising an alkyl or alkylaryl ethoxy carboxylate, a strong chelating agent and a source of alkalinity, its manufacture and use in removing greasy soil from hard surface areas is described. The compositions are especially effective in removing lime-soaps in such greasy soil especially on institutional and commercial kitchen floors.

56 Claims, No Drawings

ALKALINE CLEANERS BASED ON ALCOHOL ETHOXY CARBOXYLATES

This application is a continuation of application Ser. No. 08/469,809, filed Jun. 6, 1995, now U.S. Pat. No. 6,274,541, which is a continuation of application Ser. No. 08/200,631, filed Feb. 23, 1994, now abandoned, which application(s) are incorporated herein by reference.

BACKGROUND OF THE INVENTION

The present invention is related to an alkaline cleaner for removal of greasy soil from hard surface areas. It is especially effective in removing not only the grease but also lime-soaps found in institutional, and commercial kitchens and other food preparation environments. Prior to the present invention, the combination of food greases and lime-soaps have been difficult to clean from hard surfaces such as ceramic floor tiles or countertops. This difficulty apparently is due to unsaturated portions of materials being partially cross-linked which upon aging further polymerize.

Most lime-soap dispersants previously described contain sulfated, sulfonated or phosphonated compounds. Alkyl or alkylaryl ethoxy carboxylates are known in the art as mild surfactants for use in liquid detergent compositions. They have been described as being poor in grease cutting and require the use of other surfactants to achieve the desired cleaning. For example, international patent application, publication number WO92/08777 describes a light-duty dishwashing detergent composition containing an alkyl ethoxy carboxylate surfactant and calcium or magnesium ions and a moderate complexing agent. It was therefore surprising to find that alkyl and alkylaryl ethoxy carboxylates of the present invention are effective in removing greasy soil containing lime-soaps when such active ingredients are combined with a strong chelating agent and a source of alkalinity.

SUMMARY OF THE INVENTION

Accordingly the present invention includes an alkaline cleaner for removing greasy soil containing lime-soaps from hard surfaces such as quarry or ceramic floor tiles in commercial and institutional kitchens.

The alkaline cleaner composition comprises:

(1) an effective detersive amount of alkyl or alkylaryl ethoxy carboxylates of the formula $$R—O—(CH_2CH_2O)_n(CH_2)_m—CO_2X$$

wherein R is a $C_8$ to $C_{22}$ alkyl group or

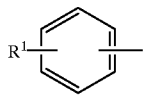

in which $R^1$ is a $C_4$–$C_{16}$ alkyl group, n is an integer of 1–20, m is an integer of 1–3, and X is hydrogen, sodium, potassium, lithium, ammonium, or an amine salt selected from monethanolamine, diethanolamine and triethanolamine;

(2) an effective amount of a strong chelating agent;

(3) an effective amount of a source of alkalinity, and (4) a diluent.

The cleaner composition can be sold as a concentrate or in the form of a dilute aqueous solution. The concentrate is preferred when sold to restaurants and institutions. Application of the concentrate is then carried out by known dilution methods.

DETAILED DESCRIPTION

As utilized herein including the claims, the term "wt %" refers to the weight proportion based upon the total weight of the composition.

The alkaline cleaner composition may be in solid or liquid form. In liquid form, the composition is preferably sold as a concentrate and used as a dilute aqueous solution. The composition includes an effective detersive amount of an alkyl or alkylaryl ethoxy carboxylate, an effective amount of a chelating agent and an effective amount of a source of alkalinity. The composition also contains a diluent. The diluent for a concentrate may be water, alcohol, or an aqueous alcohol mixture. In dilute form, the diluent is water. The composition may further contain a water conditioning agent and other typical detergent additives such as dyes, perfumes, grease cutting solvents, and the like.

By effective detersive amount is meant an amount of active ingredient required to remove grease and lime-soap dirt from a hard surface.

By an effective amount of a strong chelating agent is meant the amount required to remove the alkaline earth salts (Ca or Mg) from the water hardness used in ordinary cleaning of floor tiles and grouts. The use of chelating agents also help break up the lime-soaps under alkaline conditions and can release soaps that can help in the cleaning process.

By effective amount of a source of alkalinity is meant enough alkaline materials to break apart semi-polymerized soils formed from the fats and lime-soaps which are on hard surfaces, e.g. floor surfaces, through cooking processes. The unsaturated portions of some fats are partially cross-linked and upon aging the soils can be further polymerized. Thus highly alkaline materials such as caustics or strong amines are helpful in breaking these apart.

As a preferred aqueous alkaline cleaning composition, alkyl and alkylaryl ethoxy carboxylates can be present in an amount ranging from about 0.1 to 20 wt %, the strong chelating agent being in the range of about 1–20 wt % and the source of alkalinity being in the range of about 0.5–30 wt %.

More preferred aqueous compositions comprise:

(1) about 1–5 wt % of alkyl or alkylaryl ethoxy carboxylate;

(2) about 10–15 wt % of a strong chelating agent, and (3) about 2–12 wt % of a source of alkalinity.

The source of alkalinity is normally higher in the above range when the composition is used for commercial and institutional kitchen floors. Since the composition is useful for cleaning ceramic surfaces, the composition may also be applied in diluted form in cleaning household bathroom tiles as well as bathroom tiles in commercial locations. In this aspect, the percentage of source of alkalinity would be closer to the bottom of the above range, e.g. on or about the 2% level.

Preferred alkyl or alkylaryl ethoxy carboxylates of the above formula are those where n is an integer of 4 to 10 and m is 1.

Also preferred carboxylates are those alkyl carboxylates where R is a $C_8$–$C_{16}$ alkyl group. Most preferred of the alkyl ethoxy carboxylates are those where R is a $C_{12}$–$C_{14}$ alkyl group, n is 4 and m is 1.

In the alkylaryl series, a preferred embodiment is where R is of the formula

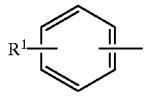

in which $R^1$ is a $C_6$–$C_{12}$ alkyl group. Most preferred is a carboxylate where $R^1$ is a $C_9$ alkyl group, n is 10 and m is 1.

The alkyl and alkylaryl carboxylates may be purchased as surfactants from commercial stores. Alternatively, they can be made by known synthetic methods starting with a fatty alcohol in the alkyl ethoxy carboxylate series. This fatty alcohol can be monitorily reacted with ethylene oxide to prepare the required number of ethoxy linkages. The resulting ethoxy alcohol is then further reacted with a halo carboxylic acid such as, for example, halo-acetic acid, halo-propionic acid or halo-butyric acid to form the desired carboxylate.

In the alkylaryl series, an alkylated phenol can be reacted in the same manner with ethylene oxide and further with the halo carboxylic acid to form the desired carboxylate.

As an example of commercially available carboxylates, Emcol CLA-40, a $C_{12-14}$ alkyl polyethoxy (4) carboxylic acid, and Emcol CNP-110, a $C_9$ alkylaryl polyethoxy (10) carboxylic acid are available from Witco Chemical. Carboxylates are also available from Sandoz, e.g. the product Sandopan® DTC, a $C_{13}$ alkyl polyethoxy (7) carboxylic acid.

The second active component in the alkaline cleaner composition is a strong chelating agent preferably in the form of its alkaline metal salt such as potassium or preferably the sodium salt. Chelating or sequestering agents are those molecules capable of coordinating the metal ions commonly found in hard water and thereby preventing the metal ions, eg. Ca and Mg, from interfering with the functioning of the detersive component of the composition. Strong chelating agents are aminopolycarboxylic acids such as, for example, nitrilotriacetic acid (NTA), ethylenediamine tetracetic acid (EDTA), N-hydroxyethyl-ethylenediamine triacetic acid (HEDTA), and diethylene-triamine pentaacetic acid (DTPA). The preferred chelating agent is ethylenediamine tetracetic acid (EDTA) in the form of its tetrasodium salt.

The third active component of the present alkaline cleaner composition is a source of alkalinity which can be an organic source or an inorganic source. Organic sources of alkalinity are often strong nitrogen bases including, for example, ammonia (ammonium hydroxide), monoethanolamine, monopropanolamine, diethanolamine, dipropanolamine, triethanolamine, tripropanolamine, and the like.

The inorganic alkaline source contained in the alkaline cleaners of this invention is preferably derived from sodium or potassium hydroxide. The preferred form is commercially available sodium hydroxide, which can be obtained in aqueous solution of concentrations of about 50 wt %.

As preferred sources of alkalinity, ammonia or ammonium hydroxide, monoethanolamine and sodium hydroxide in 50 wt % aqueous solution is preferred. Most preferred is a combination of the three.

The composition of the present invention is manufactured in either a concentrate formulation or dilute aqueous formulation. All formulations are prepared initially in concentrated form by combining the ingredients in a mixing vessel and mixing the components creating a homogeneous liquid composition.

The resulting concentrate may be diluted and bottled for household purposes for cleaning bathroom tiles.

Preferably, the concentrate is sold as such for institutional and commercial settings which require a significant amount of the compositions. The purchased concentrated composition is then diluted to the proper strength at the site where they will be used. Systems for diluting concentrates are well known in the art and are normally employed by a wide variety of users, e.g. hotels, hospitals, restaurants, etc. Dispensing systems may cover a wide range in terms of complexity. The method of dilution may be rather simple and manual or require operator experience. A preferred method for dispensing a concentrate is described in U.S. Pat. No. 5,033,649 which is incorporated herein by reference. The solution storage and dispensing apparatus has a container with two inlet ports for two different types of liquid e.g. a water and the liquid cleaning concentrate. The inlet ports for the two different types of liquid accommodate two inlet lines which transport the liquid into the container. The inlet lines are each removably interconnected to their respective liquid sources and container inlet ports. The container has a suitable proportioning means, such as an aspirator, permanently mounted inside of it.

The following examples illustrate in more detail the present invention but are not limiting thereon. The alkaline cleaner compositions of the present invention were compared with other known surfactants. The data demonstrated the superiority of the present compositions in removing soil containing grease and lime-soaps from hard surfaces such as found in commercial and institutional kitchen floors.

EXAMPLES

Typical Restaurant Floor Soil:

Samples of greasy soil from seven local restaurants were collected. These samples were scraped from the grout lines between tiles. Fourier transform infrared spectroscopy (FTIR) and nuclear magnetic resonance (NMR) analyses were made on these soil samples. The results are shown in Table 1. The soils are quite similar, and average 30–40% fats (unsaturated fatty triglycerides), 20–30% Ca or Mg fatty salts, 15–20% proteins, and the remainder being glucosides and inorganics.

The presence and levels of fats, proteins, glucosides, and inorganics were expected. What was truly surprising was the high amounts of free fatty acids, which were complexed as the alkaline earth (Ca or Mg) salts. The free fatty acids were apparently generated from high temperature cooking (deep frying, etc.) on the triglycerides. The alkaline earth ions were either from the floor tile or grout, or from the water hardness in the water used for cleaning.

These alkaline earth salts of fatty acids, commonly called lime-soaps, are not only extremely insoluble in water but also very hydrophobic and not wetted by water, making their removal difficult.

TABLE 1

FTIR analyses of grout samples

| Restaurant | Fats | Fatty Salts | Proteins | Glucosides & Inorganics |
|---|---|---|---|---|
| Site #1 | 30–40 | 10–20 | 10–20 | remainder |
| Site #2 | 30–40 | 10–20 | 20–30 | remainder |
| Site #3 | <5 | 10–15 | 30–40 | remainder |
| Site #4 | 10–20 | 20–30 | <10 | remainder |
| Site #5 | 50–60 | 10–20 | <15 | remainder |
| Site #6 | 50–60 | 20–30 | 15–20 | remainder |

TABLE 1-continued

FTIR analyses of grout samples

| Restaurant | Fats | Fatty Salts | Proteins | Glucosides & Inorganics |
|---|---|---|---|---|
| Site #7 | 20–30 | 20–30 | 30–40 | remainder |
| AVERAGE | 30–40 | 20–30 | 15–20 | remainder |

* Results are in percent.

Floor Cleaner soil Removal Lab Test:

A model floor soil was designed based on the above study of several restaurant floor soil samples. This simulated floor soil and the subsequent floor soil removal laboratory test procedure was used to test various cleaners.

PROCEDURE:

Quarry tiles soiled with a special Ca soil mixture are baked at two different temperatures: 300° F. for 1½ hours and 200° F. for 3 hours. The tiles are read on the Relative Spectral Reflectance machine before running a test. The tiles are then measured after Gardner Straight Line treatment.

The Gardner Straight Line Washability apparatus, model WG 6700 is used to clean standard soiled tiles with standard pressure and stroke of a swatch towel, using dilution concentrations of detergents.

APPARATUS AND MATERIALS:

1. Gardner Straight Line apparatus with plastic template, 21 15/16"×6 15/16"×⅛". One hole 6×6".
2. Relative Spectral Reflectance machine.
3. Cream, solid quarry tile, 6×6" panels. Supplier: Color Tile, St. Paul, Minn.
4. Swatch towel, 6×6".
5. Scour pad, 6×6".
6. Paint brush, 1" width, to deliver 5.0 gm of soil.
7. 6×6" stainless steel plate with screws.
8. Stainless steel disc. (825 gm).

| CALCIUM SOIL FORMULA: | |
|---|---|
| Powdered milk | 16.67% |
| Corn oil | 29.50% |
| Ca Linoleate | 10.00% |
| Ca Oleate | 6.67% |
| Ca stearate | 3.33% |
| Red Iron Oxide | 0.50% |
| IPA 99% (isopropyl alcohol) | 33.33% |

Ca SOIL MIXING PROCEDURE:

Add the ingredients in order into a 800 ml plastic beaker. Blend them well with a spatula before mixing. The soil mixture will be mixed with the Tekmar mixer for 5 to 10 minutes. Mix until uniform. Cover the beaker with plastic wrap. Do not leave soil uncovered for any length of time as the IPA evaporates the minimum batch size is about 500 gm for adequate mixing with the Tekmar.

TILE SOILING PROCEDURE:

1. Stir the soil well before applying (a small amount of IPA may be added if the soil has dried somewhat). Apply 5.0 gm of soil (a balance can be used) with a paint brush to the tile surface.
2. The tiles will be baked at two different temperatures at 300° F. for 1½ hours and 200° F. for 3 hours.

SOIL REMOVAL TEST PROCEDURE:

1. Make up typically at 2 oz/gal (1.5 wt. %) of each product to be tested.
2. Screw the swatch and a green scouring pad together in the stainless steel plate. Put Stainless steel disc weight on top.
3. Place soiled tile into the plastic template inside the Washability apparatus.
4. Transfer 200 gm of test solution into the Washability apparatus pan.
5. Start the machine immediately, washing the tiles for 150 cycles at 300° F. and 100 cycles at 200° F. conditions.
6. Remove tiles and rinse with cool water.
7. Allow the tiles to air dry.
8. Have a final reading as Delta Reflectance for the tiles following the same procedure as before.
9. Also, make visual estimates for percents soil removal in this test.

CALCULATIONS:

Delta Reflectance is determined by the final reading (R2) and the initial reading (R1)

$$\text{Delta Reflectance}=R2-R1$$

Visual soil removal estimates are used to complement the delta reflectance readings.

Visual estimates can be graded with a scale that is comfortable to the operator. For example, one can use a scale of 0 to 100 percent removal or use a scale of 1 to 4.

1=0–25%

2=25–50%

3=50–75%

4=75–100%

Floor Soil Removal Test Results and Discussion:

Table 2 show 8 formulations labeled Modified OASIS 111-1 to 8. These were designed to be compared with an Ecolab liquid alkaline floor cleaner product, OASIS 111. The formulations were also designed to have roughly matching costs. The formulations were made up by mixing the ingredients named in Table 2 for each OASIS numbered sample in distilled (D1) water. Each formulation contains the same percentages of perfume and dyes—pine perfume, 0.1 wt %; Acid Green 25, an anthraquinone dye, 0.005 wt %; Yellow 8 BR (Acid Yellow 23), 0.006 wt %. OASIS 111 and modified OASIS 111-1 contain HF-055, an alcohol ethoxylate of a $C_{12}$–$C_{14}$ alcohol and 18 mole ethylene oxide adduct, Ecolab, as an active ingredient. OASIS 111-2 and 111-3 contain in varying amounts as active ingredients a combination of Rewoteric AMB-14, cocamido propylbetaine, Rewo Chemical Group, Steol CS-460, sodium laureth sulfate, Stepan Chemical Co., and Supra 2, lauryldimethylamine oxide, Ecolab. The latter combination is known to remove loose (non-polymerized) grease. Finally, samples labeled OASIS 111-4 to 111-8 contain as an active ingredient an alcohol ethoxy carboxylate of the present invention, EMCOL CNP-110, having the formula

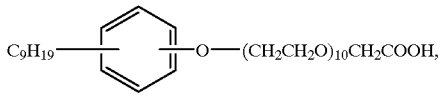

available from WITCO Chemical Corp. The lab floor soil removal test results are shown at the bottom of Table 2.

The test results generally show the superiority of Emcol CNP-110, an excellent lime-soap dispersant, over HF-055, and the combination of Rewoteric AMB-14/Steol CS-460/Supra 2.

TABLE 2

| RAW MATERIAL | OASIS 111 | MODIFIED OASIS 111-1 | OASIS 111-2 | OASIS 111-3 | OASIS 111-4 | OASIS 111-5 | OASIS 111-6 | OASIS 111-7 | OASIS 111-8 |
|---|---|---|---|---|---|---|---|---|---|
| D1 WATER (BALANCE) | | | | | | | | | |
| NaOH, 50% | 2.0 | 2.0 | 2.0 | 2.0 | 2.0 | 2.0 | 10.0 | | 6.0 |
| RU SILICATE | 3.0 | | | | | | | | |
| MEA, 99% | 6.0 | 6.0 | 6.0 | | 6.0 | | | 8.0 | 6.0 |
| NH4OH, 30% NH3 | 2.0 | 2.0 | 2.0 | 2.0 | 2.0 | | | | |
| BUTYL CELLOSOLVE | 4.0 | | | | | | | | |
| HF-055 | 3.0 | 3.0 | | | | | | | |
| REWOTERIC | | | 2.0 | 5.5 | | | | | |
| AMB-14 | | | (0.6) | (1.65) | | | | | |
| STEOL CS-460 | | | 0.5 | 1.375 | | | | | |
| | | | (0.3) | (0.83) | | | | | |
| SUPRA 2 | | | 0.5 | 1.375 | | | | | |
| | | | (0.15) | (0.41) | | | | | |
| EMCOL | | | | | 2.0 | 4.0 | 3.6 | 2.0 | 2.0 |
| CNP-110 | | | | (1.30) | (2.60) | (2.34) | (1.30) | (1.30) | |
| VERSENE 100 | 7.0 | 13.0 | 13.0 | 13.0 | 13.0 | 13.0 | 13.0 | 13.0 | 13.0 |
| DYE & PERFUME (q.s.) | | | | | | | | | |
| RELATIVE % REMOVAL OF SOIL BAKED AT 300° F. FOR 1.5 HOURS; PRODUCT TESTED AT 1.5%. | | | | | | | | | |
| 1ST SERIES | 35.0 | 46.0 | 42.0 | 28.0 | | | | | |
| 2ND SERIES | 35.0 | 50.0 | | | 65.0 | 30.0 | 50.0 | 52.0 | 60.0 |
| RELATIVE % REMOVAL OF SOIL BAKED AT 200° F. FOR 3.0 HOURS; PRODUCT TESTED AT 1.5%. | | | | | | | | | |
| 1ST SERIES | 12.0 | 19.0 | 17.0 | 9.6 | | | | | |
| 2ND SERIES | 12.0 | 12.0 | | | 15.0 | 15.0 | 25.0 | 15.0 | 20.0 |

NOTE: NUMBERS IN PARENTHESES ARE % OF SURFACTANTS ADJUSTED TO 100% ACTIVITY.

Lime Soap Dispersing Test:

In this test, the abilities of various reputedly good lime-soap dispersants were compared with the alkaline cleaner compositions of the present invention in removing pre-formed calcium stearate, calcium oleate, and calcium linoleate in aqueous solution. The concentration of the surfactants used was 2 wt % and the concentration of the lime-soap used was 0.2%. The surfactants tested were:

| | Trade Name/ | Manufacturer |
|---|---|---|
| Sodium laureth sulfate | Steol CS-460/ | Stepan |
| Cocamidopropyl hydroxy sultaine | Varion CAS-W/ | Sherex |
| Alkylated naphthalene sulfonate, sodium salt | Morwet D-425/ | Witco |
| $C_{12}$—$C_{14}$ Alkyl polyethoxy (4) carboxylic acid | Emcol CLA-40/ | Witco |
| $C_9$ Alkylaryl polyethoxy (10) carboxylic acid | Emcol CNP-110/ | Witco |

The test results indicate that Steol CS-460, Varion CAS-W, and Morwet D-425 have very minimal lime-soap removing abilities. On the other hand, the test results show Emcol CLA-40 and Emcol CNP-110 of the present invention to be excellent lime-soap removal agents and also good solubilizing agents (fraction of the lime-soap is solubilized in solution, not just suspended from precipitating).

What is claimed is:

1. An aqueous alkaline cleaner composition for removing greasy oil containing lime-soaps from hard quarry or ceramic tile surfaces consisting essentially of:

about 0.1–20 wt-% of an alkyl ethoxy carboxylate of the formula:

$$R—O—(CH_2CH_2O)_n(CH_2)_m—CO_2X$$

wherein R is a $C_8$–$C_{22}$ alkyl group, n is an integer of 1–20, m is an integer of 1–3, and X is hydrogen, sodium, potassium, lithium, ammonium, or an amine cation;

the amine being monoethanolamine, diethanolamine, or triethanolamine;

about 1–20 wt-% of a chelating agent, the chelating agent being nitrilotriacetic acid, ethylenediamine tetraacetic acid, N-hydroxyethyl-ethylenediamine triacetic acid, diethylene-triamine pentaacetic acid, or combination thereof; and 8–30 wt-% of a source of alkalinity.

2. The composition of claim 1, wherein n is an integer of 4–10 and m is 1.

3. The composition of claim 2, wherein R is a $C_8$–$C_{16}$ alkyl group.

4. The composition of claim 3, wherein R is a $C_{12}$–$C_{14}$ alkyl group, n is 4 and m is 1.

5. The composition of claim 4, wherein the chelating agent is the tetrasodium salt of ethylenediaminetetraacetic acid.

6. The composition of claim 4, wherein the alkaline source is monoethanolamine, sodium hydroxide, ammonium hydroxide, or mixtures thereof.

7. The composition of claim 1, wherein the chelating agent is ethylenediaminetetraacetic acid, nitrilotriacetic acid, alkali metal salt thereof, or combination thereof.

8. The composition of claim 1, wherein the alkaline source is monoethanolamine, diethanolamine, triethanolamine, potassium hydroxide, sodium hydroxide, ammonia, ammonium hydroxide, or mixtures thereof.

9. The composition of claim 1, consisting essentially of:

alkyl ethoxycarboxylates of the formula $$R—O—(CH_2CH_2O)_4CH_2CO_2X$$

wherein R is a $C_{12}$–$C_{14}$ alkyl group;

tetrasodium salt of ethylenediaminetetraacetic acid, and monoethanolamine, sodium hydroxide, ammonium hydroxide, ammonium hydroxide or a mixture thereof.

10. A method for removing greasy soil containing lime-soaps from hard quarry or ceramic tile surfaces comprising:

applying to said surface a dilute aqueous alkaline cleaner composition, which consists essentially of in concentrate form:

about 0.1–20 wt-% alkyl ethoxy carboxylate of the formula;

$$R—O—(CH_2CH_2O)_n(CH_2)_m—CO_2X$$

wherein R is a $C_8$–$C_{22}$ alkyl group, n is an integer of 1–20, m is an integer of 1–3, and X is hydrogen, sodium, potassium, lithium or ammonium, or an amine cation;

the amine being monoethanolamine, diethanolamine or triethanolamine;

about 1–20 wt-% of a chelating agent, the chelating agent being nitrilotriacetic acid, ethylenediamine tetraacetic acid, N-hydroxyethyl-ethylenediamine triacetic acid, and diethylene-triamine pentaacetic acid, and 8–30 wt-% of a source of alkalinity.

11. The method of claim 10, wherein n is an integer of 4–10 and m is 1.

12. The method of claim 11, wherein R is a $C_8$–$C_{16}$ alkyl group.

13. The method of claim 12, wherein R is a $C_{12-C14}$ alkyl group, n is 4 and m is 1.

14. The method of claim 13, wherein the chelating agent is the tetrasodium salt of ethylenediaminetetraacetic acid.

15. The method of claim 13, wherein the alkaline source is monoethanolamine, sodium hydroxide, ammonium hydroxide, or mixtures thereof.

16. The method of claim 10, wherein the chelating agent is ethylenediaminetetraacetic acid, nitrilotriacetic acid, alkali metal salt thereof, or combination thereof.

17. The method of claim 10, wherein the alkaline source is monoethanolamine, diethanolamine, triethanolamine, potassium hydroxide, sodium hydroxide, ammonia, ammonium hydroxide, or mixture thereof.

18. The method of claim 10, wherein the composition consists essentially of:

alkyl ethoxycarboxylates of the formula $$R—O—(CH_2CH_2O)_4CH_2CO_2X$$

wherein R is a $C_{12}$–$C_{14}$ alkyl group;

tetrasodium salt of ethylenediaminetetraacetic acid, and monoethanolamine, sodium hydroxide, ammonium hydroxide or a mixture thereof.

19. An aqueous alkaline cleaner composition for removing greasy soil containing lime-soaps from hard quarry or ceramic tile surfaces consisting essentially of:

about 0.1–20 wt-% of an alkyl ethoxy carboxylate of the formula;

$$R—O—(CH_2CH_2O)_n(CH_2)_m—CO_2X$$

wherein R is a $C_8$ –$C_{22}$ alkyl group, n is an integer of 1–20, m is an integer of 1–3, and X is potassium;

about 1–20 wt-% of a chelating agent being nitrilotriacetic acid, ethylenediamine tetraacetic acid, N-hydroxyethyl-ethylenediamine triacetic acid, diethylene-triamine pentaacetic acid, or mixtures thereof; and 8–30 wt-% of a source of potassium hydroxide.

20. The composition of claim 19, wherein n is an integer of 4–10 and m is 1.

21. The composition of claim 20, wherein R is a $C_8$–$C_{16}$ alkyl group.

22. The composition of claim 21, wherein R is a $C_{12}$–$C_{14}$ alkyl group, n is 4 and m is 1.

23. The composition of claim 19, wherein the chelating agent is ethylenediaminetetraacetic acid, nitrilotriacetic acid, alkali metal salt thereof, or combination thereof.

24. A method for removing greasy soil containing lime-soaps from hard quarry or ceramic tile surfaces comprising:

applying to said surface a dilute aqueous alkaline cleaner composition, which consists essentially of in concentrate form:

about 0.1–20 wt-% of an alkyl ethoxy carboxylate of the formula;

$$R—O—(CH_2CH_2O)_n(CH_2)_m—CO_2X$$

wherein R is a $C_8$–$C_{22}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxethyl-ethylenediamine triacetic acid, and diethylene-triamine pentaacetic acid, and 8–30 wt-% of a source of potassium hydroxide.

25. The method of claim 24, wherein n is an integer of 4–10 and m is 1.

26. The method of claim 25, wherein R is a $C_8$–$C_{16}$ alkyl group.

27. The method of claim 26, wherein R is a $C_{12}$–$C_{14}$ alkyl group, n is 4 and m is 1.

28. The method of claim 24, wherein the chelating agent is ethylenediaminetetraacetic acid, nitrilotriacetic acid, alkali metal salt thereof, or combination thereof.

29. An aqueous alkaline cleaner composition for removing greasy soil containing lime-soaps from hard quarry or ceramic tile surfaces consisting essentially of:

about 0.1–20 wt-% of an alkylaryl ethoxy carboxylate of the formula:

$$R—O—(CH_2CH_2O)_n(CH_2)_m—CO_2X$$

wherein R is

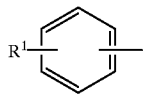

in which $R^1$ is a $C_4$–$C_{16}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxethyl-ethylenediamine triacetic acid, and diethylene-triamine pentaacetic acid; and about 2–30 wt-% of a source of potassium hydroxide.

30. The composition of claim 29, wherein R is

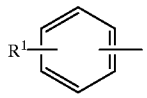

in which $R^1$ is a $C_6$–$C_{12}$ alkyl group.

31. The composition of claim 30, wherein $R^1$ is a $C_9$ alkyl group, n is 10 and m is 1.

32. The composition of claim 29, wherein n is an integer of 4–10 and m is 1.

33. The composition of claim 29, wherein the chelating agent is ethylenediaminetetraacetic acid, nitrilotriacetic acid, alkali metal salt thereof, or combination thereof.

34. A method for removing greasy soil containing lime-soaps from hard quarry or ceramic tile surfaces comprising:

applying to said surface a dilute aqueous alkaline cleaner composition, which consists essentially of in concentrate form:

about 0.1–20 wt-% of an alkylaryl ethoxy carboxylate of the formula;

$$R—O—(CH_2CH_2O)_n(CH_2)_m—CO_2X$$

Wherein R is

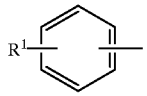

in which $R^1$ is a $C_4$–$C_{16}$ alkyl group, n is an integer of 1–20, m is an integer of 1–3, and X is potassium;

about 1–20 wt-% of a chelating agent selected from the group consisting of nitrilotriacetic acid, ethylenediamine tetraacetic acid, N-hydroxyethyl-ethylenediamine triacetic acid, and diethylene-triamine pentaacetic acid, and about 2–20 wt-% of a source of potassium hydroxide.

35. The method of claim 34, wherein R is

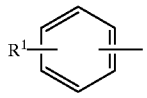

in which $R^1$ is a $C_6$–$C_{12}$ alkyl group.

36. The method of claim 35, wherein $R^1$ is a $C_9$ alkyl group, n is 10 and m is 1.

37. The method of claim 34, wherein n is an integer of 4–10 and m is 1.

38. The method of claim 34, wherein the chelating agent is ethylenediaminetetraacetic acid, nitrilotriacetic acid, alkali metal salt thereof, or combination thereof.

39. A method for removing greasy soil containing lime-soaps from bathroom hard surfaces comprising:

applying to said surface a dilute aqueous alkaline cleaner composition, which consists essentially of in concentrate form:

about 0.1–20 wt-% of alkyl ethoxy carboxylate of the formula;

$$R—O—(CH_2CH_2O)_n(CH_2)_mCO_2X$$

wherein R is a $C_8$–$C_{22}$ alkyl group, n is an integer of 1–20, m is an integer of 1–3, and X is hydrogen, sodium, potassium, lithium, ammonium, or an amine cation;

the amine being monoethanolamine, diethanolamine or triethanolamine;

about 1–20 wt-% of a chelating agent, the chelating agent being nitrilotriacetic acid, ethylenediamine tetraacetic acid, N-hydroxyethyl-ethylenediamine triacetic acid, and diethylene-triamine pentaacetic acid, and 8–30 wt-% of a source of alkalinity.

40. The method of claim 39, wherein n is an integer of 4–10 and m is 1.

41. The method of claim 40, wherein R is a $C_8$–$C_{16}$ alkyl group.

42. The method of claim 41, wherein R is a $C_{12}$–$C_{14}$ alkyl group, n is 4 and m is 1.

43. The method of claim 42, wherein the chelating agent is the tetrasodium salt of ethylenediaminetetraacetic acid.

44. The method of claim 42, wherein the alkaline source is monoethanolamine, sodium hydroxide, ammonium hydroxide, or mixtures thereof.

45. The method of claim 39, wherein the chelating agent is ethylenediaminetetraacetic acid, nitrilotriacetic acid, alkali metal salt thereof, or combination thereof.

46. The method of claim 39, wherein the alkaline source is monoethanolamine, diethanolamine, triethanolamine, potassium hydroxide, sodium hydroxide, ammonia, ammonium hydroxide, or mixture thereof.

47. The method of claim 39, wherein the composition consists essentially of:

alkyl ethoxycarboxylates of the formula $$R—O—(CH_2CH_2O)_4CH_2CO_2X$$

wherein R is a $C_{12}$–$C_{14}$ alkyl group;

tetrasodium salt of ethylenediaminetetraacetic acid, and monoethanolamine, sodium hydroxide, ammonium hydroxide or a mixture thereof.

48. A method for removing greasy soil containing lime-soaps from bathroom hard surfaces comprising:

applying to said surface a dilute aqueous alkaline cleaner composition which consists essentially of in concentrate form:

about 0.1–20 wt-% of an alkylaryl ethoxy carboxylate of the formula;

$$R—O—(CH_2CH_2O)_n(CH_2)_m—CO_2X$$

wherein R is

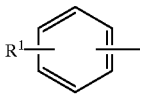

in which $R^1$ is a $C_4$–$C_{16}$ alkyl group, n is an integer of 1–20, m is an integer of 1–3, and X is hydrogen, sodium, potassium, lithium, ammonium, or an amine cation;

the amine being monoethanolamine, diethanolamine or triethanolamine;

about 1–20 wt-% of a chelating agent, the chelating agent being nitrilotriacetic acid, ethylenediamine tetraacetic acid, N-hydroxyethyl-ethylenediamine triacetic acid, and diethylene-triamine pentaacetic acid, and about 2–30 wt-% of a source of alkalinity.

49. The method of claim 48, wherein R is

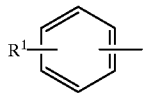

in which $R^1$ is a $C_6$–$C_{12}$ alkyl group.

50. The method of claim 49, wherein $R^1$ is a $C_9$ alkyl group, n is 10 and m is 1.

51. The method of claim 48, wherein the composition consists essentially of:

alkylaryl ethoxy carboxylates of the formula

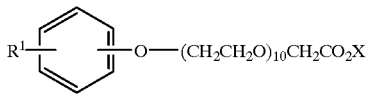

in which $R^1$ is a $C_9$ alkyl group;

tetrasodium salt of ethylenediaminetetraacetic acid, and monoethanolamine, sodium hydroxide, ammonium hydroxide or a mixture thereof.

52. The method of claim 48, wherein n is an integer of 4–10 and m is 1.

53. The method of claim 52, wherein the chelating agent is the tetrasodium salt of ethylenediaminetetraacetic acid.

54. The method of claim 52, wherein the alkaline source is monethanolamine, sodium hydroxide, ammonium hydroxide, or mixtures thereof.

55. The method of claim 48, wherein the chelating agent is ethylenediaminetetraacetic acid, nitrilotriacetic acid, alkali metal salt thereof, or combination thereof.

56. The method of claim 48, wherein the alkaline source is monoethanolamine, diethanolamine, triethanolamine, potassium hydroxide, sodium hydroxide, ammonia, ammonium hydroxide, or mixture thereof.

* * * * *